United States Patent [19]

Barrell

[11] 4,122,639

[45] Oct. 31, 1978

[54] BUILDING STRUCTURE

[75] Inventor: John M. Barrell, Peachtree City, Ga.

[73] Assignee: Renaissance Creations, Inc., Atlanta, Ga.

[21] Appl. No.: 758,718

[22] Filed: Jan. 12, 1977

[51] Int. Cl.[2] ..... E04C 3/07

[52] U.S. Cl. ..... 52/90

[58] Field of Search ..... 52/90, 92, 82, 86, 71, 52/98, 105, 70; 46/12, 30

[56] References Cited

U.S. PATENT DOCUMENTS

| | | | |
|---|---|---|---|
| 3,564,785 | 2/1971 | Kephart | 52/86 |
| 3,747,290 | 7/1973 | Barrell | 52/90 |
| 3,798,852 | 3/1974 | Nicoll | 52/90 |

*Primary Examiner*—J. Karl Bell

*Attorney, Agent, or Firm*—J. Wesley Everett

[57] ABSTRACT

The building is constructed from precut and scored sheets which are folded into panels for constructing both the side walls and roof. The invention relates in general to the assembled building particularly to the roof construction, the anchoring of the side walls to the footing, and construction of the double panel window sill. The roof panel is provided particularly with an eave portion extending at least beyond the plane of the side walls and folded at an acute angle and secured to the head sill.

2 Claims, 23 Drawing Figures

FIG. 2-A

BUILDING STRUCTURE

The present invention relates to an improved building constructed of precut and foldable sheets of thin board-like material, foldable into reenforced panels wherein the panels are arranged in side-by-side relationship to form both the wall and roof structure.

One object of the invention is to provide a novel roof construction for extra long spans of roof.

Another object of the invention is to provide an improved means for securing the lower end of the side-wall panels to a footing.

A further object of the invention is to provide a window still structure to extend over one or more panel members.

A further object of the invention is to provide a building structure that will have a greater capacity to with stand earth tremors and earthquakes.

While several objects of the invention have been set forth, other objects, uses and advantages will become apparent as the nature of the invention is more fully disclosed in the following specifications with reference to the accompanying drawing wherein.

Figure 1:
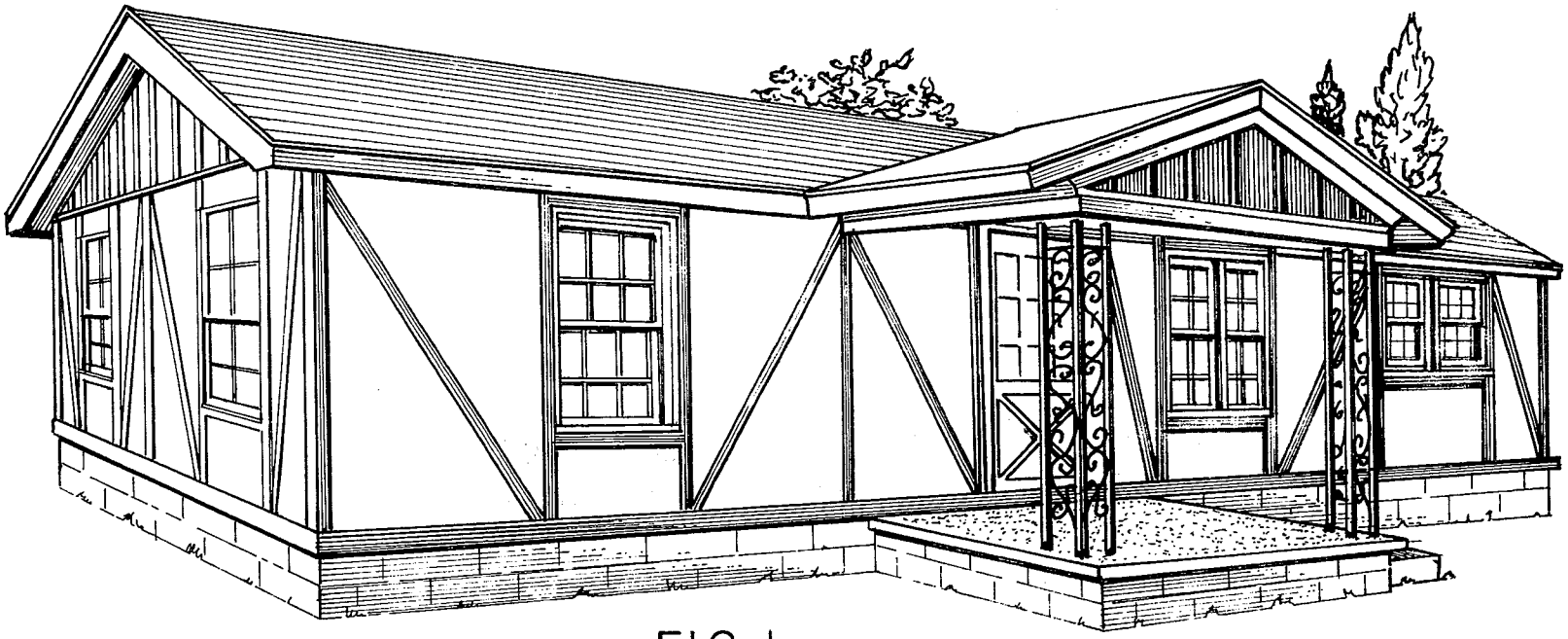
FIG. 1 is a rendition of a finished building in perspective.
Figure 2:
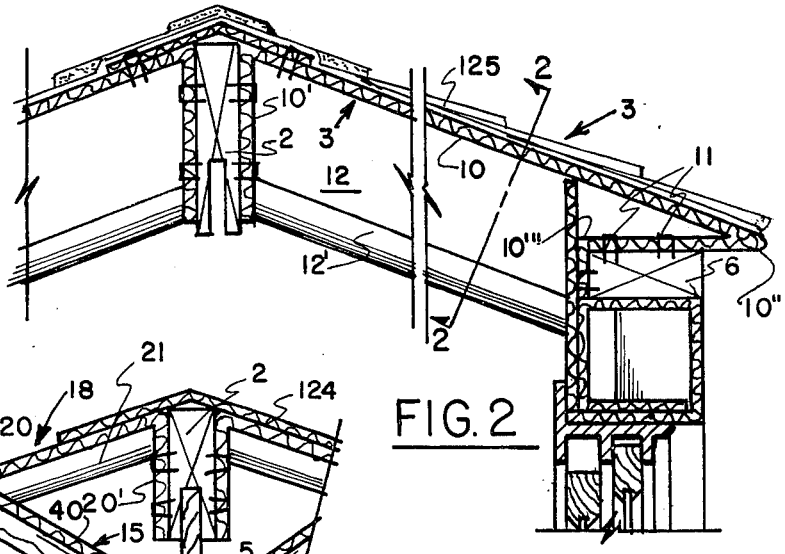
FIG. 2 is an enlarged fragmentary sectional view of a roof wherein the roof is of such size that one-half of the roof may be made from a plurality of single panels.

FIG. 2-A is a sectional view taken on line 2—2 of FIG. 2.

Figure 3:
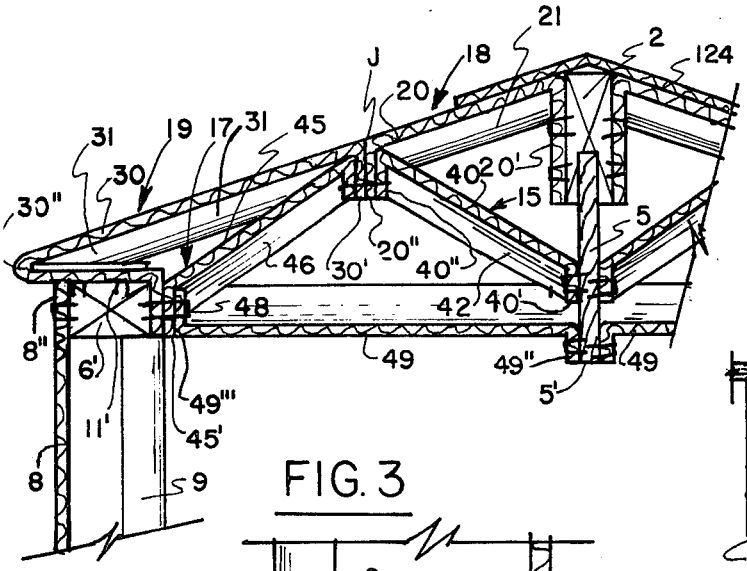

FIG. 3 is a sectional view of a roof section showing a roof constructed of two panels in length.

Figure 4:
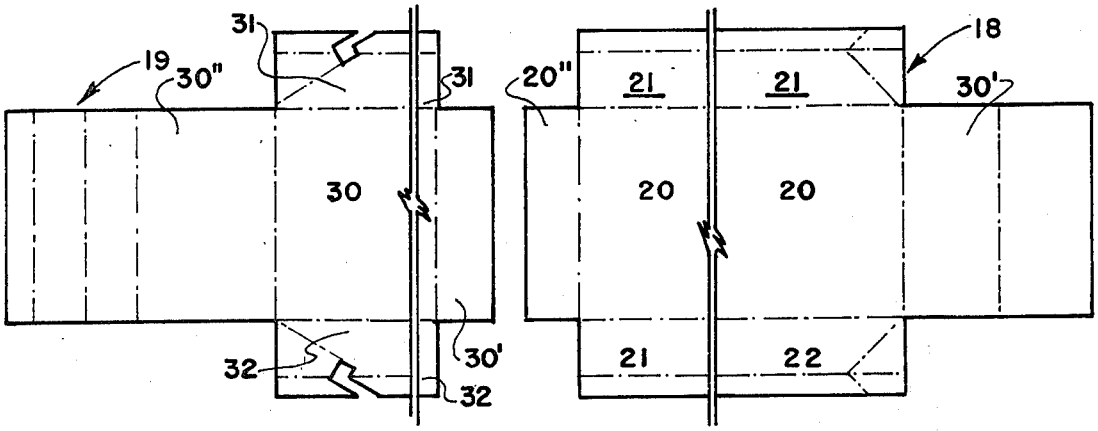

FIG. 4 is a fragmentary precut and scored sheet from which the two parts of the panel are made in forming a roof as shown in FIG. 3.

Figure 5:
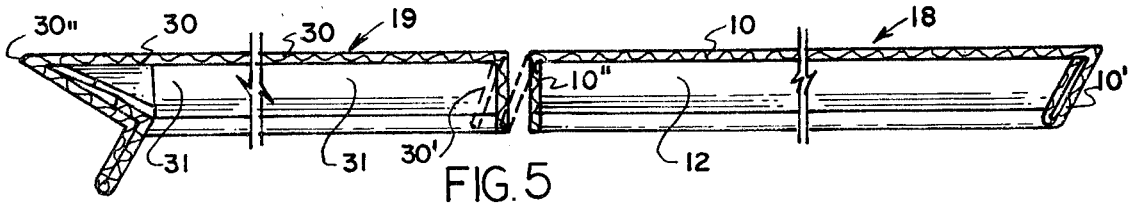

FIG. 5 is a fragmentary sectional view of a two-part roof panel ready to be placed in position.

Figure 6:
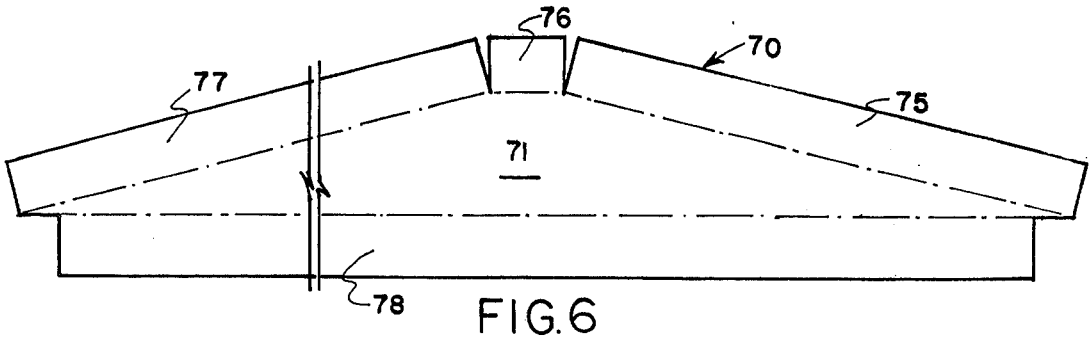

FIG. 6 is a precut and scored sheet of material used to form the gable end section of the roof.

Figure 7:
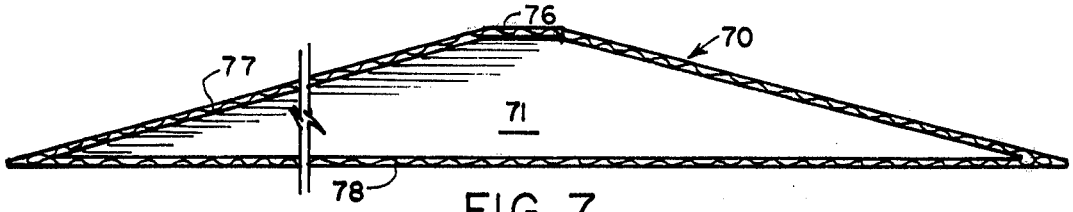

FIG. 7 is a fragmentary sectional view of the gable end of the roof formed from the blank shown in FIG. 6.

Figure 8:
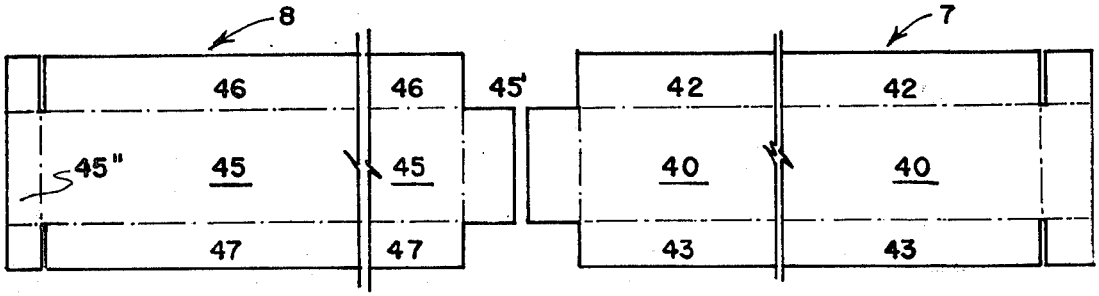

FIG. 8 is a precut and scored support panel for the two sectional roof panels as shown in FIG. 3.

Figure 9:
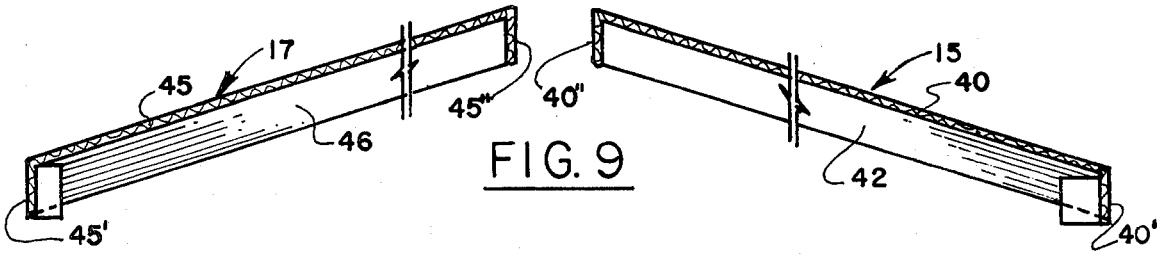

FIG. 9 is a sectional view of the support member folded and ready to be installed in position, as shown in FIG. 3.

Figure 10:
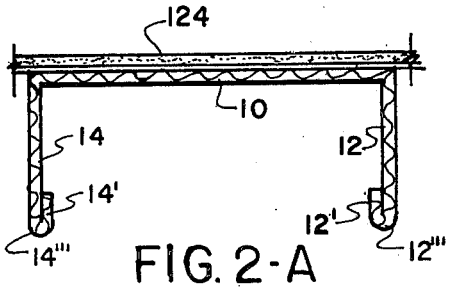
Figure 10:
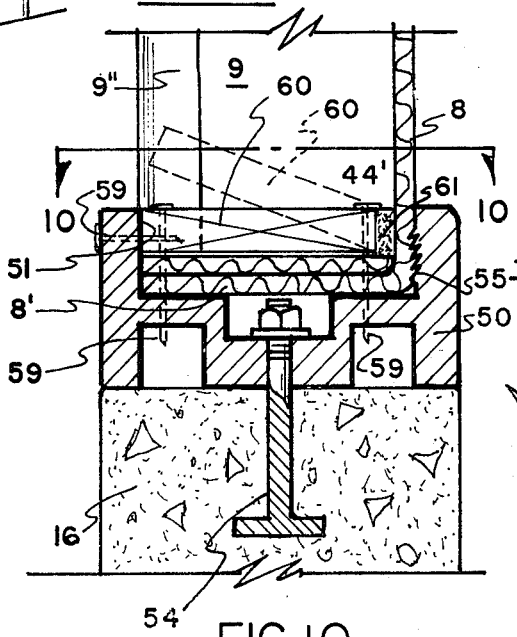

FIG. 10 is an enlarged fragmentary sectional view of an improved method of securing the side wall panel to the footing.

Figure 11:
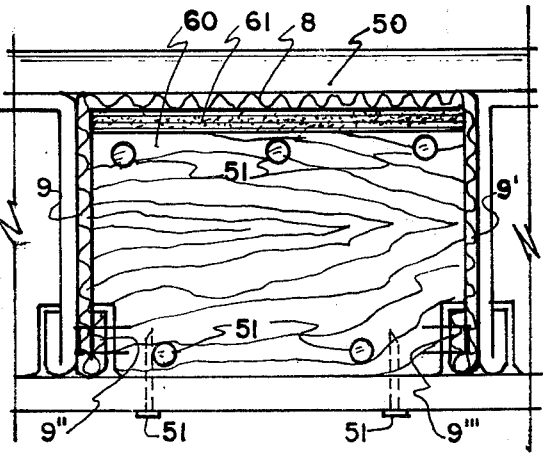

FIG. 11 is a sectional view taken along line 10—10 of FIG. 10.

Figure 12:
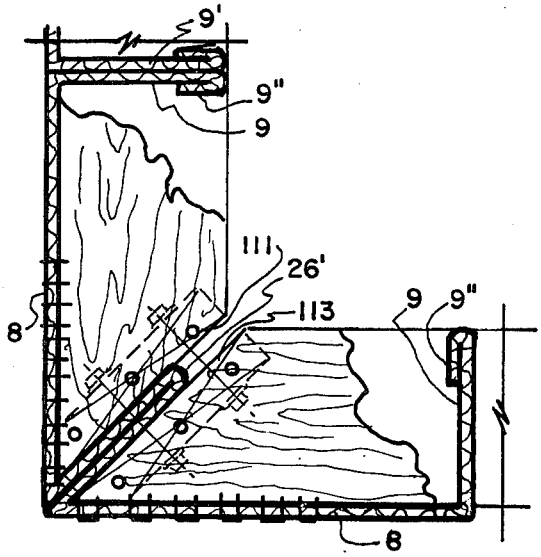

FIG. 12 is a horizontal sectional view of a corner of the building.

Figure 13:
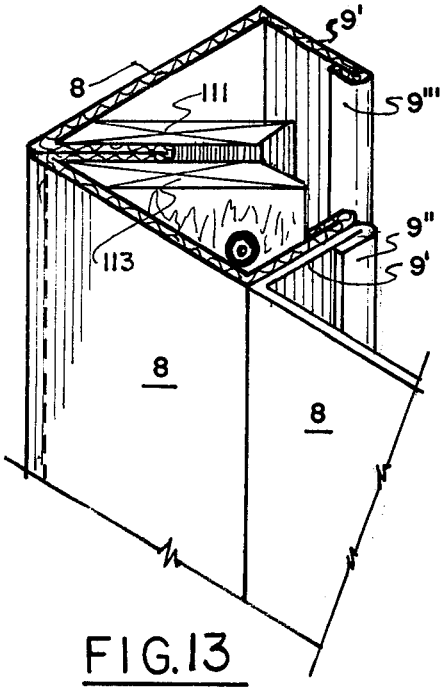

FIG. 13 is an isometric view of the same.

Figure 14:
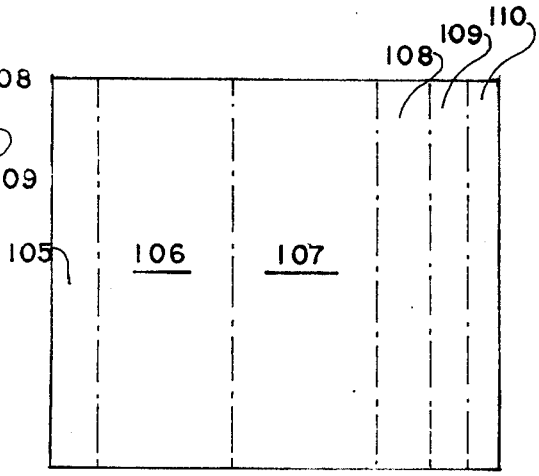

FIG. 14 is a precut and scored blank for forming the reenforcing element for the bottom window sill.

Figure 15:
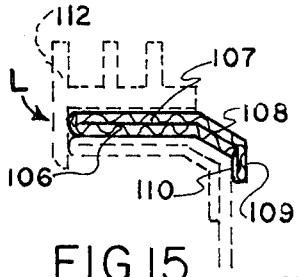

FIG. 15 is a sectional view of the lower window sill when the blank in FIG. 14 is folded.

Figure 16:
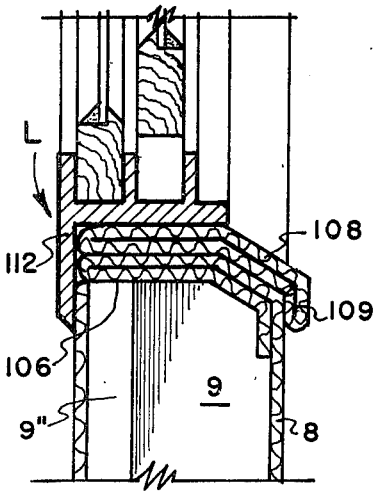

FIG. 16 is an enlarged sectional view of the lower window sill similar to that shown in FIG. 15.

Figure 17:
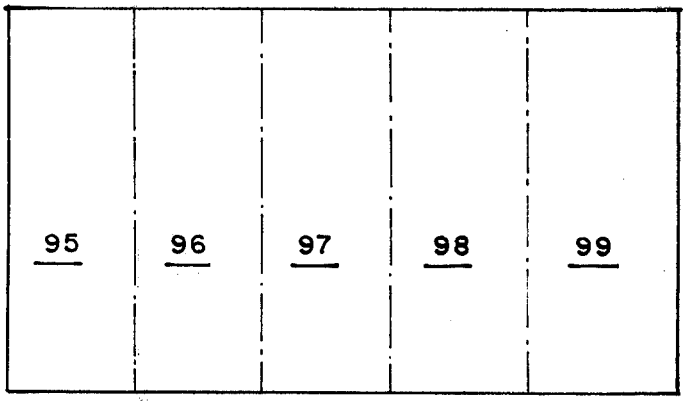

FIG. 17 is a precut and scored blank sheet for forming the reenforced upper window sill.

Figure 18:
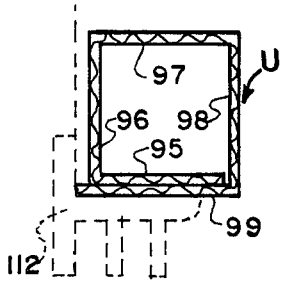

FIG. 18 is a sectional view of the folded panel shown in FIG. 17.

Figure 19:
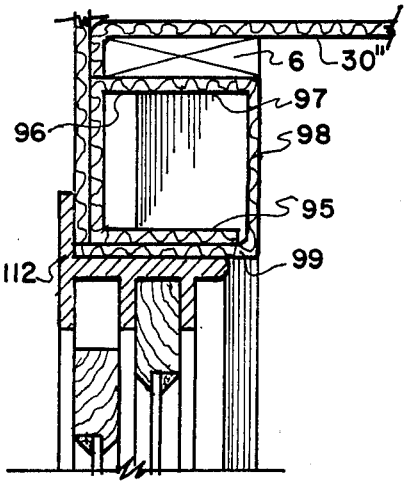

FIG. 19 is an enlarged fragmentary sectional view showing an assembly of the upper window sill and sash.

Figure 20:
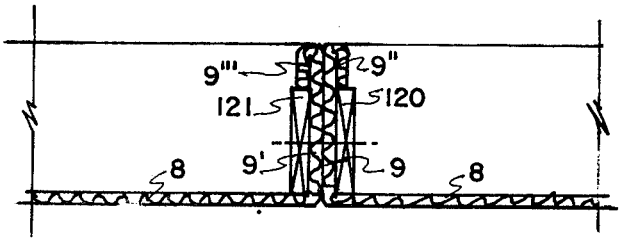

FIG. 20 is a transverse sectional view of a wall panel wherein the side wall is shown reenforced for supporting the head sill.

Figure 21:
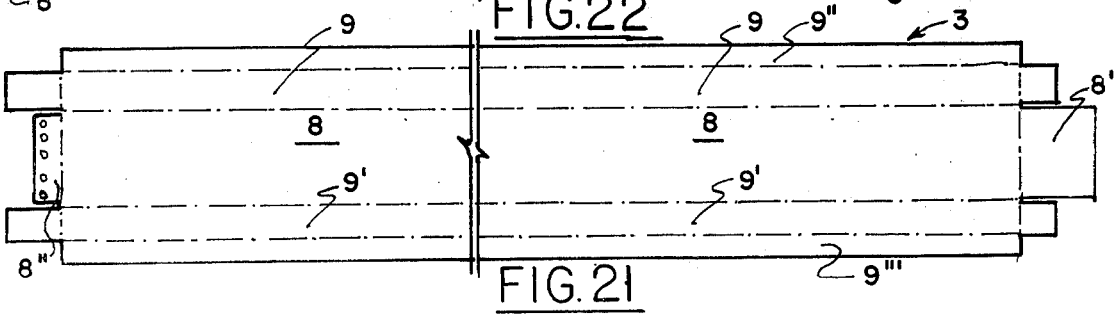

FIG. 21 shows a precut and scored side wall panel, and

Figure 22:
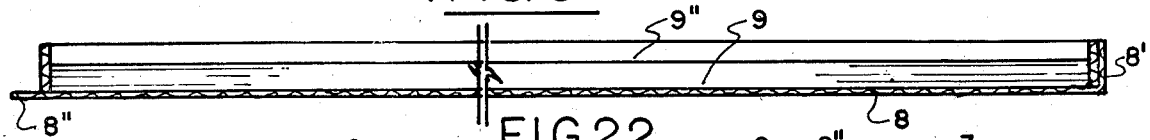

FIG. 22 shows a folded side wall panel ready for installing.

Referring first to the roof structure, there are shown two forms. One form of the roof is shown in FIG. 2, and the other form is shown in FIG. 3.

The form shown in FIG. 2 is for use where the distance from the ridge member 2 to the head sill 6 is not too great, and the roof panels are formed from a single precut and scored sheet. In the form shown in FIG. 3, a single panel unit is formed from two precut sheets and placed end to end to form a single panel unit as shown in FIGS. 4 and 5.

In FIG. 2 the roof panel 3 is shown with a center section 10 and side members 12 and 14. These roof panels are formed very similar to the side panels, that is, they are formed with a relatively wide center portion 10 and two side sections folded to 90° to the center section to form relatively narrow side sections 12 and 14. The outer edges of the side sections 12 and 14 are folded inwardly and adjacent the inner surfaces of the side sections as shown in FIG. 2A at 12' and 14' to reenforce the outer edges 12''' and 14'''. The inner end of the center portion 10 is extended and angled downwardly to be secured to the ridge member 2 as shown at 10'. The outer end 10'' of the portion 10 is folded at an acute angle to form an eave, and extends along the top side of the head sill 6 as shown at 10''', and is secured to the head sill by the staples 11, or other suitable means.

In FIG. 3 there is shown a roof stucture for a greater roof span than that shown in FIG. 2. For this structure each roof panel is shown in two sections 18 and 19 which are of substantially the same general structure as that described for the single roof panels in FIG. 2. The panel 18 is formed with a central section 20 and two side sections 21 and 22. The inner end of the central section 20 is provided with an angled portion 20' and is attached to the ridge member 2, and the opposite end of the central section 20 is provided with an angled portion 20'' and is adapted to be connected with the angled portion 30' carried on the inner end of the central portion 30 of the roof panel 19. Panel 19 is of substantially the same general form as panel 18, that is, it has a broad central portion 30 and two narrow side portions 31 and 32. The inner end of the central portion is extended as shown at 30' and is folded downwardly and connected to the folded portion 20'' of panel 18. The outer end 30'' of the central portion 30 of the panel 19 is folded at an acute angle to form an eave and extends along the top of the head sill 6' and is secured to the head sill by suitable staples 11', or other suitable means.

Extending downwardly from the ridge member 2 is an extension 5 for securing one end of a roof brace. The extension 5 is preferably of such width that the lower edge 5' is in a plane substantially horizontal with the head sills 6 and 6' for also supporting one of more ends of ceiling panels 49 and 49'.

On the longer roof span shown in FIG. 3 there is provided a pair of roof brace elements 15 and 17 for supporting the roof at the junction J of the two panel members 18 and 19. The roof braces are of substantially the same general structure as the wall and roof panels. The brace element 15 is provided with a broad central section 40 and two narrow side sections 42 and 43. The central section 40 is extended at its inner end to provide an obtuse angled portion 40' which is attached to the vertical side of the extension 5 of the ridge element 2 and the opposite end 40'' of the brace member 15 extends outwardly and upwardly to engage the junction J of the two roof panels 18 and 19.

The roof brace 17 is also provided with a broad central section 45 and two narrow-side sections 46 and 47. The central section 45 is extended outwardly to provide a portion 45' which is angled and secured to the head sill 6' by staples 48, or other suitable means. The brace element 17 extends upwardly and inwardly to the junction J of the panel members 18 and 19 where it is fixed to the upper end of the brace 15 and the two inner ends 20'' and 30' of the roof panels 18 and 19.

The side wall panels are shown in detail in FIGS. 21 and 22 having a center section 8 and two side sections 9 and 9', and two outer edge sections 9'' and 9''' which are folded adjacent and parallel with the side sections 9 and 9' respectively. The upper end of the side panel 8 is extended as shown in FIGS. 21 and 22 at 8'' and is secured to the head sill 6'' as shown in FIG. 3.

In order to reenforce the panel side walls there is provided a pair of supporting elements 120 and 121 secured on each of the folded sections 9 and 9' at predetermined places throughout the lenght of the wall. These reenforcing elements may be of any desirable rigid material.

Extending lateraly from the upper end of the side walls are horizontal ceiling panels 49 having their inner edges 49'' fixed to the extension 5 of the ridge member 2, and the opposite edges of the panels being fixed adjacent the head sills 6 and 6' as shown at 49''' in FIG. 3.

For securing the lower end of the side wall to the footing 16 there is preferably provided an extrusion 50 having a groove 51 in its upper surface for receiving the folded-over ends of the several side wall members as shown in FIGS. 10 and 11. The folded-over ends of the side walls, shown at 8', are placed within the groove 51 of the extrusion 50 and the central section 8 is wedged against a plurality of projections 55 on the inside surface of the groove by blocks 60. The blocks 60 are provided with a resilient element 61 which presses the central section 8 against the projections after the blocks have been pressed down into place as shown by the full lines in FIG. 10 for aiding in holding the side wall in the groove 51 of the extrusion 50. Suitable nails 59 are then driven through the block, the folded portion 8' and the element 50 to secure the block and side all in place. The extrusion 50 is held to the footing 16 by the bolt 54.

Another innovation is to provide a window sill that is extendable over several panels members without showing the the seams between the side wall panels. This is done for the lower window sill L by forming a blank sheet as shown in FIG. 14 which is laid out in a plurality of panels 105, 106, 107, 108, 109 and 110. The sheet is folded as shown in FIGS. 15 and 16 and placed over the opening in the wall panel as shown in FIG. 16. The folded portions 109 and 110 form a drip for the lower window sill. However, these sills may be of any desired length to extend over any number of side wall panels into which a standard preformed window sash 112 may be installed. A similar window sill may be made for the upper sill shown in FIGS. 17, 18 and 19. The upper window sill U is formed similar to the lower window sill L, that is, a blank sheet is scored as shown in FIG. 17 into panels 95, 96, 97, 98 and 99. The sheet is folded as shown in FIGS. 18 and 19 and takes the place of the upper portion of a side wall panel.

The corners of the building are made from a single sheet of material as shown in FIGS. 12 and 13 in which a side panel 8 is formed on each side of the corner and in a single sheet. The sheet is folded upon itself as shown at 26' and clamped between two rigid members 111 and 113. This construction ties the walls into a single unit and insures the corners of the building from opening up, and also provides a more sturdy construction.

After the basic roof structure has been completed a suitable outer roof, such as that shown at 125 in FIGS. 2 and 3 may be applied.

The panels are all secured in place by stapling, nailing, gluing, and any other conventional means.

The outer surface of the side wall panels may be covered with any suitable type material, which is also true of the inside, and the building is completely waterproofed and fire-proofed throughout.

While the invention is shown is a specific form, it is not intended as a limitation thereof, for what is claimed as to invention is set forth in the appended claims.

I claim:

1. A building construction of prefabricated, abutted, vertical panels of a predetermined height to form a side wall for said building, the upper ends of said vertical side wall panels having means extending substantially horizontally over the upper ends thereof for supporting at least one side of a roof, the improved roof comprising:

a. said roof being formed with a plurality of roof panels wherein each panel is formed in two sections extending in the same plane from the side wall of the building to a laterally extended ridge member, each of the two roof sections being joined at one of the respective ends, the opposite end of one of the roof panel sections extending upwardly to a said lateral ridge member and means for securing said roof panel to the ridge member, the opposite end of the opposite roof panel section extending downwardly to substantially the horizontal side supporting means carried on the upper end of the side panels and means for fixing the said ends of the roof panels to the said roof supporting means carried by the side wall;

b. said lateral ridge member extending downwardly to a distance ending substantially in a horizontal plane with the upper ends of the wall members;

c. said jointure of the two roof sections having matched turned-in edges to engage each other and means for joining said ends to each other, and a pair of reinforcing roof members one extending angularly downwardly from the jointure of the two roof sections to the upper end of the side wall, and the opposite end of the other reinforcing member extending angularly downwardly and in the opposite direction from the jointure of the two roof section members to substantially the lower edge of the extended ridge member, and means for securing said members at their respective ends.

2. In a building construction as claimed in claim 1 wherein a substantially horizontal ceiling member is adapted to extend from the upper end of the side wall to the lower edge of the ridge member, and means for securing the said ceiling to the adjacent upper end of the side wall and the ridge member.

* * * * *